US005315713A

United States Patent [19]

Pileggi

[11] Patent Number: 5,315,713

[45] Date of Patent: May 31, 1994

[54] APPARATUS FOR RESTRAINING A VARIETY OF NECKTIES

[76] Inventor: Vincent J. Pileggi, 1847 Dillon Rd., Maple Glen, Pa. 19002

[21] Appl. No.: 967,224

[22] Filed: Oct. 27, 1992

Related U.S. Application Data

[63] Continuation-in-part of Ser. No. 818,081, Jan. 8, 1992, which is a continuation-in-part of Ser. No. 774,796, Oct. 10, 1991, abandoned, which is a continuation-in-part of Ser. No. 724,835, Jul. 2, 1991.

[51] Int. Cl.[5] ..... A41D 25/00; A41D 27/00

[52] U.S. Cl. ..... 2/145; 2/144; 24/50; 24/56; 24/49 R

[58] Field of Search ..... 2/145, 146, 144, 147, 2/148, 155, 157, 52; 24/49 R, 49 CF, 49 S, 49 TS, 50, 56

[56] References Cited

U.S. PATENT DOCUMENTS

| | | | |
|---|---|---|---|
| 1,273,261 | 7/1918 | Mills, Jr. . | |
| 1,291,090 | 1/1919 | Nuzum | 2/145 |
| 1,644,863 | 10/1927 | Weisbaum | 2/145 X |
| 1,751,963 | 3/1930 | Weinschreider | 2/145 |
| 1,960,145 | 5/1934 | Edelheit | 2/145 |
| 2,006,427 | 7/1935 | Wolfson . | |
| 2,090,816 | 8/1937 | Snider . | |
| 2,389,784 | 11/1945 | Kennedy . | |
| 2,588,576 | 3/1952 | Roop et al. . | |
| 2,652,569 | 9/1953 | Confino . | |
| 2,746,055 | 5/1956 | Gleason . | |
| 3,042,983 | 7/1962 | Riedler . | |
| 3,453,696 | 7/1969 | Mates . | |
| 3,613,117 | 10/1971 | Gingerich | 2/149 |
| 3,639,916 | 2/1972 | Vaughn . | |
| 4,123,802 | 11/1978 | Ackerman | 2/144 |
| 4,324,004 | 4/1982 | Smith et al. | 2/131 |
| 4,631,752 | 12/1986 | Heyman et al. . | |
| 4,827,536 | 5/1989 | Sung . | |
| 4,827,576 | 5/1989 | Prince . | |
| 4,835,821 | 6/1989 | Durante . | |
| 4,920,579 | 5/1990 | Swain . | |
| 4,972,523 | 11/1990 | Begg . | |
| 5,012,530 | 5/1991 | Ackerman . | |
| 5,073,987 | 12/1991 | Crosier . | |
| 5,095,546 | 3/1992 | Jones | 2/145 |
| 5,109,547 | 5/1992 | Abdallah . | |

FOREIGN PATENT DOCUMENTS

| | | | |
|---|---|---|---|
| 158526 | 8/1954 | Australia . | |
| 822985 | 10/1951 | Fed. Rep. of Germany . | |
| 2156395 | 11/1971 | Fed. Rep. of Germany . | |
| 2843826 | 4/1980 | Fed. Rep. of Germany . | |
| 1023486 | 12/1952 | France . | |
| 2610796 | 8/1988 | France . | |
| 291166 | 9/1953 | Switzerland . | |
| 359097 | 10/1931 | United Kingdom | 2/145 |
| 526793 | 9/1940 | United Kingdom | 2/145 |
| 706225 | 3/1954 | United Kingdom | 2/145 |

*Primary Examiner*—Clifford D. Crowder
*Assistant Examiner*—Jeanette E. Chapman
*Attorney, Agent, or Firm*—John W. Logan, Jr.

[57] ABSTRACT

The present invention is directed to improved apparatus for restraining a necktie to a shirt. The present invention employs attachment means on the back of a conventional necktie to secure the tie's normally concealed tail in two positions, and a horizontal member, having buttonholes therein, slidably mounted on the tail between the attachment means. The horizontal member may then be secured to a shirt button to hold the tie in place during normal wear. The apparatus allows the necktie to automatically adjust to compensate for changes in the amount of slack on the necktie. Various alternative attachment means are disclosed, including means for ease in providing restraint apparatus for "clip-on" and other pre-tied neckwear.

4 Claims, 2 Drawing Sheets

APPARATUS FOR RESTRAINING A VARIETY OF NECKTIES

The present application is a continuation-in-part of U. S. Patent application Ser. No. 818,081, filed Jan. 8, 1992, which is a continuation-in-part of U.S. Patent application Ser. No. 774,796, filed Oct. 10, 1991, abandoned which is a continuation-in-part of U.S. Patent application Ser. No. 724,835, filed Jul. 2, 1991.

BACKGROUND OF THE INVENTION

1. Field of the Invention

The present invention relates to means for restraining neckties, and more particularly, to an improved apparatus to anchor a necktie to a shirt so that it remains properly restrained and centered when adorned.

2. Description of the Prior Art

A conventional "four-in-hand" necktie is tied about the neck with a knot at a shirt collar and generally has an outward facing section passing down the shirt front to conceal shirt buttons and a somewhat narrower tail section which hangs down from the knot and is concealed by the outward facing section. Normally, a wearer might use one of a number of possible methods to control a tie, including: letting both the outward section and the tail section hang free; passing the tail section through a manufacturer's label regularly provided on the back of the outward facing section so that the two sections of the tie hang as a unit; or attaching the two sections to the shirt by use of various forms of jewelry, such as a tie-tack, a tie bar or a tie pin to keep the tie in place.

The problem with the non-restrained methods of wearing a tie mentioned above is that the tie sections hang free. This not only regularly presents disarray in appearance, but the tie sections frequently interfere with work, are soiled or ruined by dragging through food or other staining material, and may be quite hazardous if accidentally caught in a doorway or machinery.

The use of jewelry holding devices is common, but also suffers from a number of drawbacks. First, these devices often pass in and out of favor depending on preference and fashion trends. Second, they are often expensive and regularly cause damage to the fabric by creating permanent holes, creases, and blemishes in the tie. Finally, these jewelry devices anchor the tie to the shirt and often do not permit vertical movement of the tie relative to the shirt. Torso movements of the wearer cause the anchored tie to pull on the knot causing displacement of the knot and general disarray so as not to present an elegant appearance.

Not surprisingly, a number of solutions have been proposed to attempt to avoid the above problems, but none is believed wholly satisfactory. U.S. Pat. No. 4,920,579 to Swain describes an apparatus to restrain necktie tails of a four-in-hand tie at the front of the shirt by relying on the manufacturer's sewn-in-place label on the back of the outward facing section and a flat plastic loop threaded through that label and attached to buttons on the shirt front. The plastic loop is somewhat stiff and has button holes at each end with a fixed distance between them. This arrangement is believed to have numerous drawbacks, including that it is awkward to employ— requiring keeping track of the loop, re-positioning the loop each time a new tie is worn, and often re-tying of the tie to center the device properly. Further, this device relies on the distance between buttons fixed by the manufacturer of the shirt which is not always the same from shirt to shirt. Moreover, this device may cause tie damage through constant pulling on the manufacturer's label—a use for which the label is not designed. Finally, the stiff plastic loop may prove uncomfortable to wear.

Another approach is described in U.S. Pat. No. 4,827,576 to Prince, Jr. There a button-slot neck tie fastener is permanently affixed to the manufacturer's label and a stiff portion having button slots is affixed to a shirt button. Apparently the tie's vertical movement relative to the shirt is permitted by the slot engaging the button. This device is believed to suffer from most of the same drawbacks as the Swain device, and may have the additional problem of possibly wearing out the shirt front where it contacts the device and the button stitching--thus possibly damaging both the tie and the shirt.

Still another solution to keeping a conventional tie in proper position is disclosed by U.S. Pat. No. 4,972,523 to Begg. Begg contemplates the use of complementary VELCRO ®-type loop-and-hook material, with a first element thereof on the back of the outward facing section and a second element thereof on a loop around the tail section. The second element has a slot on its opposite side for engagement with a shirt button. The two hook-and-loop elements engage each other to hold the tie in position and the tail section of the tie is threaded through the loop. Although this arrangement solves some of the problems presented by the Swain and Prince devices, its separate elements are believed to be somewhat awkward to use and the loop element may be prone to loss. More importantly, this design does not allow vertical movement of the tie relative to the shirt to follow movement of the torso of the wearer—leading to some of the same presentation problems as conventional jewelry restraining devices.

U.S. Pat. No. 5,109,547 to Abdallah proposes attaching a somewhat cumbersome plastic base member to the rear of the front portion of the tie and intertwining a slidable member through slots in the base member for attachment to a shirt button. Although this design may solve some of the problems for after-market necktie restraint, it is still considered deficient in a number of aspects. First, the relatively large base member, which is suggested to be constructed from a plastic material, is considered to be unnecessarily awkward for ease in tying the necktie--particularly with respect to passing the front apron of the tie through the knot. Further, this device can be heavy in comparison to the weight of the material from which the tie is fabricated, thus placing unnecessary stress on the tie material and presenting a stiff look during normal movements of the wearer.

Yet another anchoring device is U.S. Pat. No. 5,095,546 to Jones. Jones proposes a slidable device which is anchored to, or formed as a continuous part of, the back of a tie. Although this device may cure some of the problems discussed above, this patent is devoid of teaching or suggestion of how to best proportion and construct such a device. Additionally, nothing in this patent teaches how to readily adapt such a device for after-market use.

Applicant's device disclosed in the parent applications solves many of these problems. That invention employs a tie restraint apparatus with a vertical member attached at its top and bottom to the back of the front section of the tie and a relatively wide horizontal member which surrounds the vertical member and slides between the vertical member's top and bottom positions. The horizontal member includes multiple buttonholes along its length so that the wide horizontal member may be properly positioned. As is disclosed, ideally the vertical and horizontal members are constructed from a material similar in appearance to the tie material itself and include a backing of fusion cloth or comparable material which provides sufficient stiffness for proper operation of the apparatus.

In operation, once the necktie is tied in a conventional manner, the horizontal member is easily slid into a position on the vertical member which aligns with an opening with a button on the shirt. The button is then secured within the opening to provide an anchor for the tie. The concealed tail section of the tie may be inserted through the horizontal member to keep it safely secure.

The attachment of the horizontal member to the shirt has proven to be a very secure method of retaining the tie in place. This is due in part to the free movement of the horizontal member on the vertical member which assures that the tie always stays in a straight and low-stress orientation. Moreover, the invention of the parent application is extremely simple and reliable in operation, may be instantly attached without complicated positioning of the tie relative to shirt buttons, may be inexpensively incorporated as original equipment on any conventional tie, and, due to its automatic adjustability, always presents an orderly appearance regardless of a wearer's torso movement.

Despite the many advantages of the invention of the parent application, alternate less costly methods of restraining the necktie are considered to be possible. First, it is believed desirable to provide some form of tie restraint apparatus which can deliver most of the performance of the applicant's original device, but can be readily installed on existing neckwear. Second, it is believed that these same concepts can be employed to create a simplified and less expensive apparatus for use on pre-tied neckwear (e.g. "clip-on" ties).

Accordingly, it is a primary object of the present invention to provide an apparatus for maintaining a necktie in place which is effective, yet camouflaged from view by the ordinary observer.

It is a further object of the present invention to provide such an apparatus which can be easily and quickly installed on existing neckwear with minimal stress on the neckwear.

It is another object of the present invention to provide such an apparatus which is as inexpensive, simple and straightforward as possible to be readily adapted for full scale production.

It is yet another object of the present invention to provide such an apparatus which can be inexpensively adapted for use with pre-tied neckwear.

These and other objects of the present invention will become evident from review of the following specification.

SUMMARY OF THE INVENTION

The present invention provides improved apparatus for anchoring dangling sections of a necktie to a shirt.

As an improvement to the tie restraint apparatus disclosed in the parent applications, the present invention provides an alternate means for attaching the tail section to the rear of the front section of a necktie. In the parent applications, the basic restraint apparatus employs a vertical section anchored to the back of the tie and a horizontal section surrounding the vertical section and slidably mounted thereon. The horizontal section has buttonholes therein to attach the apparatus to a shirt.

In the preferred embodiment, the tie restraint apparatus is constructed using the tail of the necktie itself as a vertical section on which a separate horizontal section is mounted. This is accomplished by providing means to anchor the tail section at two points on the back of the outward facing apron of the tie. As is explained, this can be accomplished on virtually any tie by one of a variety of mounting means (including clips, loops of material, etc.) which can removably secure to the tail. For ties with a fixed knot (e.g. "clip-on" ties and other pre-tied units), it is preferred to anchor the tail of the tie permanently in such a position by sewing, gluing or other means. A horizontal member is then slidably mounted on the tail, so that when the tail is held to the apron, the horizontal member is adjustable therebetween. Once adorned, the apparatus of the present invention functions in a manner indistinguishable from that of the parent applications.

The present invention provides a simple and effective means of constructing a secure anchor for a tie which presents the best possible appearance at all times while keeping the tie clean, safe and out of harm's way. Additionally, the apparatus of the present invention may be easily mounted on virtually any tie with minimal time and expense. For use on pre-tied ties, the present invention provides an even less expensive means to maintain the tie in a neat and safe orientation.

DESCRIPTION OF THE DRAWINGS

The operation of the present invention should become apparent from the following description when considered in conjunction with the accompanying drawings, in which.

DETAILED DESCRIPTION OF THE INVENTION

The present invention is an improved apparatus and method for securing a necktie to a shirt to prevent it from being dislodged from a centered position.

Figure 2:
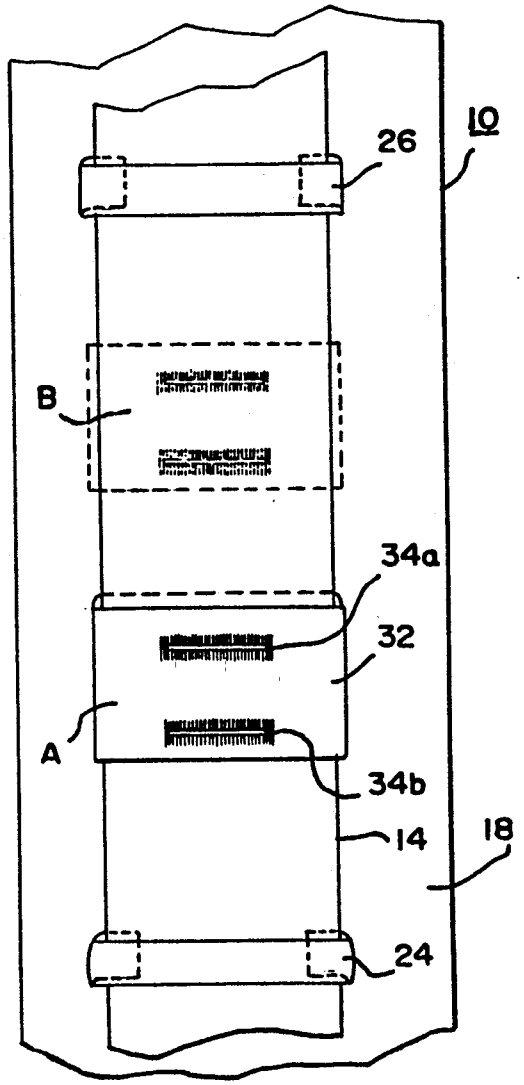
FIG. 2 is an enlarged fragmentary view of the back of the tie illustrated in FIG. 1.
Figure 1:
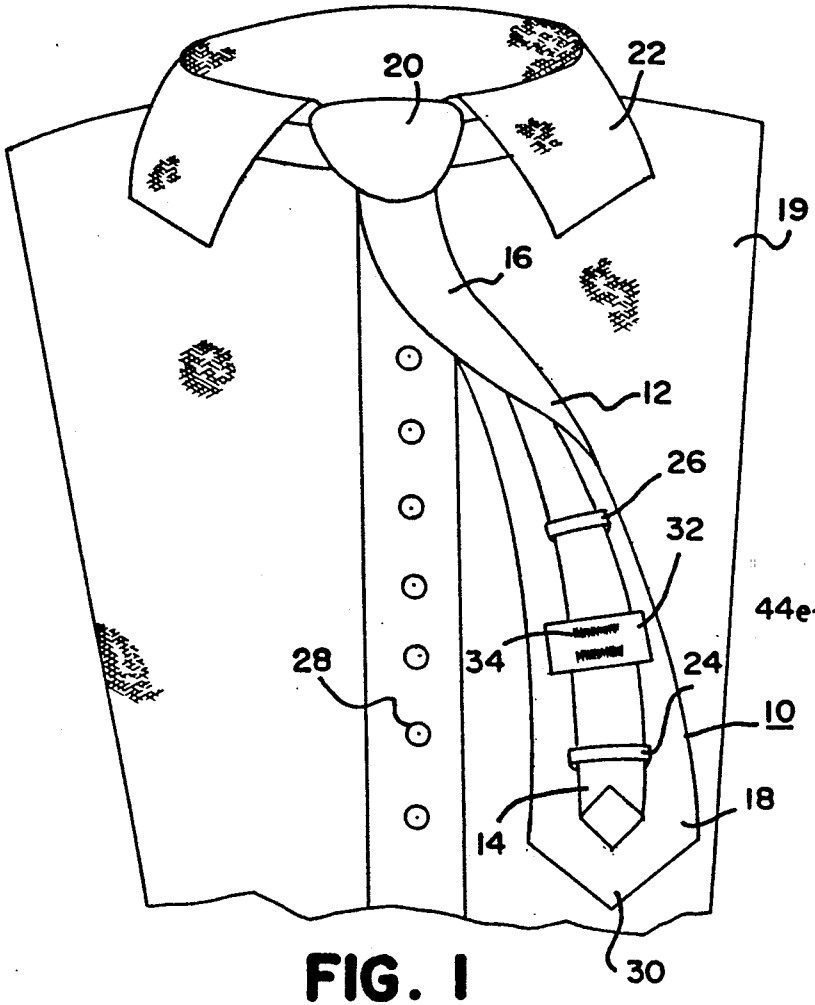
FIG. 1 is an elevational view of one embodiment of the tie restraint apparatus of the present invention attached to a necktie.

One embodiment of the tie restraint apparatus of the present invention is shown in FIGS. 1 and 2. This apparatus employs a conventional necktie 10 having a front apron 12 and a tail 14. The apron 12 has an outward facing front 16, which is displayed when the necktie is worn, and a back 18, which faces a shirt 19 and usually hides the tail 14 from view by an ordinary observer. As is known, the tie 10 is normally tied in one of a number of conventional knots 20 at the neck and is generally worn under a collar 22.

In this embodiment, the tie restraining apparatus of the present invention includes a tail attachment means in the form of a lower attachment loop 24 and an upper attachment loop 26. Each of the loops 24, 26 are attached to the back 18 of the tie apron in such a manner that the tail 14 can be easily slid down through them in the manner shown. As is explained below, the tail attachment means of the present invention can take any suitable form and may be either permanently or temporarily attached to the back 18 of the apron 12.

The loops 24, 26 of this embodiment of the present invention are formed from a flexible cloth material, preferably similar or identical to the tie in texture and color. These loops should be attached far enough apart to comfortably span at least two buttons 28 on a dress shirt, generally this comprises approximately 5 to 8 inches, with a distance of about 7" being preferred. The loops should be attached as close to the tie's lower end 30 as is practicable to provide the best restraint for the tie. However, since it is important that the tail 14 of the tie is secured within both loops 24, 26 at all times during use, for most applications for most standard length ties, the lower loop 24 should be attached approximately 3 ¼ to 5 inches above the end 30 of the tie.

It should be noted that the tie restraint apparatus of the present invention functions best when buttoned as low as possible on a wearer's shirt, retaining the entire length of the tie close to the wearer at all times. Accordingly, the lower loop generally should be anchored as close as possible to the end of the tie while still concealing the tie tail.

In keeping with the goal of anchoring the apparatus of the present invention low on the tie, a number of other improvements may be provided with the present invention. For instance, the lower loop may be provided with means to help retain the tail of the tie within the lower loop, such as a hook-and-loop, pin, clip, or other fastener attached between the low-anchored loop and the tie tail. Additionally, it has been found that the present invention functions better with a slightly longer tie; for most wearers, a tie incorporating the present invention should be 56 ½ inches or longer.

The loops 24, 26 may be constructed from any suitably flexible material, ideally one that matches the tie in feel and color. The width of the strips of material forming the loops may vary from as thin as ⅛ inch to as wide as two inches, while the length of the strip should be equal to the width of the tail plus ¼ to 1 inch to allow space for the tail to adjust when inserted therethrough and to allow room to affix the loops to the tie.

The anchoring of the attachment means to the tie is preferably done on a permanent basis. To accomplish this, sewing, gluing, fusing, or other similar methods may be employed. For ease in after-market application, the loops 24, 26 may be provided with a double-faced fusing tape or pre-applied adhesive, such as a heat-activated adhesive commonly employed today for the application of patches and similar devices to clothing, to permit the loops to be readily applied to the tie merely through ironing. As is shown in FIG. 2, the loops 24, 26 should be folded over when applied to permit their widths to be carefully proportioned to form a relatively snug fit for the tail 14 to help maintain the tail 14 in place.

A horizontal member 32 is provided with one or more button holes 34*a*, 34*b* adapted to attach to one of the buttons 28 on the wearer's shirt. Once the tie is tied and properly adjusted, the wearer then slides the tail 14 through the upper loop 26. At this stage, the horizontal member 32 is slid onto the tail 14, positioned immediately below the upper loop 26, and the tail 14 is then attached through the lower loop 24 to secure the horizontal member 32 intermediate the ends of the tail 14. In this manner, the horizontal member 32 is slidably mounted to tail 14 between the two loops 24, 26, permitting the restraint apparatus 30 to self-adjust.

At this stage the horizontal member 32 may be slid into an appropriate position to be anchored to a shirt button 28. For maximum restraint, the horizontal member 32 should be anchored to the lowest available button 28. As is shown, when worn the horizontal member 32 will automatically slide between the two loops 24, 26 to maintain a straight and attractive presentation of the tie at all times, regardless of the wearer's torso movement. Two of the many possible positions of the horizontal member 28 are shown in FIG. 2 at positions A and B.

As is shown in FIG. 2, preferably the horizontal member 32 is constructed out of a length of material which is attached to itself around the tail 14, such as through sewing, adhesive, or other fastening means. This may alternatively entail a semi-rigid C-shaped horizontal member 32 which partially surrounds the tail 14 so to prevent it from falling off.

The horizontal member 32 is provided with one or more openings or "button holes" 34 therein to provide means to attach the horizontal member 32 to a button 28. As is explained below, for the horizontal member 32 to function properly, it should be at least an inch or more in width. Accordingly, it is preferred that more than one opening 34 should be provided to provide options in the proper alignment of the apparatus. Alternatively, other attachment means between the horizontal member 32 and a button may be employed within the general scope of the contemplated invention, such as substituting for a button hole any other opening (e.g. in the form of a loop of thread or a hook attached to a small chain) affixed to the horizontal member 32 which may engage around or behind a button.

It should be appreciated that the horizontal member 32 may be constructed from any desired material. Appropriate materials include those natural and man-made fibers normally employed in tie construction, such as cotton, polyester, and silk, as well as virtually any other material which can be securely anchored to a tie. Preferably, the apparatus should be constructed from a durable material or materials which allow the horizontal member 32 to slide easily relative to the tail section 14, such as polymer fabric (which may also be relatively inexpensive), or a material which complements the quality of the material in the tie (e.g. silk).

The horizontal member 32 should be wide enough to anchor to a button while comfortably surrounding the tail section 14. For most present tie dimensions, a width of 1 ½ to 2 inches provides sufficient room to permit easy sliding adjustment between the horizontal member 34 and the tail section 14. It has been found that a horizontal member that is either too narrow (e.g. under 1" in width) or too wide (e.g. greater than 2 ½" in width) will not slide smoothly along the tail 14 of the tie and will tend to "hang-up" when worn.

To achieve far better operation of the present invention, it is preferred that the horizontal member 32 and/or the tail 14 of the tie is treated with a stiffener to decrease tendency of the horizontal member to snag along the tail. Although the stiffener may take any form, such as starch or plastic coating of the tie, preferably such stiffener comprises a fusion cloth, such as the product available under the trademark PELLON® from Freudenberg Nonwovens of Chelmsford, Mass. This product is available in a wide variety of cloth grades and types of adhesives. For use with a 100% silk material, it has been found that the best results may be possible by employing a "heavy" grade of fused cloth in the tie tail, and a "heavy" or "extra heavy" grade of fused cloth in the horizontal member. The bonding process occurs at a temperature of approximately 250°-290° F. against the fusion cloth and approximately 270°-300° F. against the tie material. For a typical five foot length of cloth, pressure is applied over a period of approximately 20-30 seconds. The particular parameters for each application may vary depending on the type of material, grade of fusion cloth, type of adhesive, and particular environmental conditions.

The addition of fusion cloth significantly improves the sliding interface between the two members and may improve the durability of the apparatus 30 as a whole. Since it is desirable to manufacture the horizontal member from the same material as the tie itself to improve camouflage of the apparatus, when a tie material such as silk is employed the horizontal member 32 and the tail section 14 may be lined to achieve the desired stiffness.

For most after-market applications, the desired stiffness can be readily achieved. With respect to the horizontal member 32, stiffness may be provided through the use of a coating on the finished horizontal member, such as starch, plastic, etc., and/or by backing the horizontal member 32 during construction with a material to improve its stiffness, such as bonding a fusion cloth to the horizontal member 32. Stiffness to the tail 14 of an existing tie, if it is required at all, can be easily accomplished by having the consumer provide a conventional starch or similar coating to the tie tail.

The tie restraint apparatus securely anchors the tie 10 to the shirt and keeps it centered and close to the shirt in all forms of activities. However, the apparatus is completely concealed and is in no way noticeable to the wearer or others. Additionally, since the restraining device is self-adjusting, it provides the best presentation of the tie at all times without inconveniencing the wearer.

One embodiment of the attachment means 34 represented in FIG. 1 is a strip of material attached to the back of the apron so that a channel is formed between the tie and the strip of material 32 through which the tail can be passed. In this embodiment of the attachment means, it is preferred that the material is the same material as the tie, so that it is not apparent to an observer.

Figure 4:
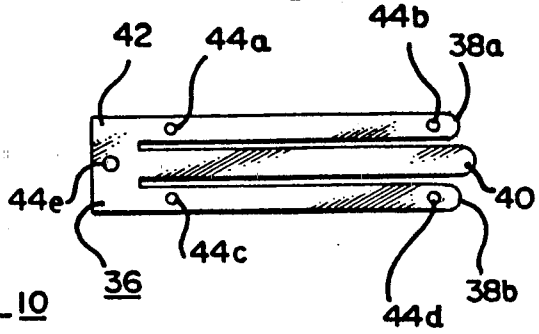
FIG. 4 is a plan view of the clip component used with the second embodiment of the present invention.
Figure 3:
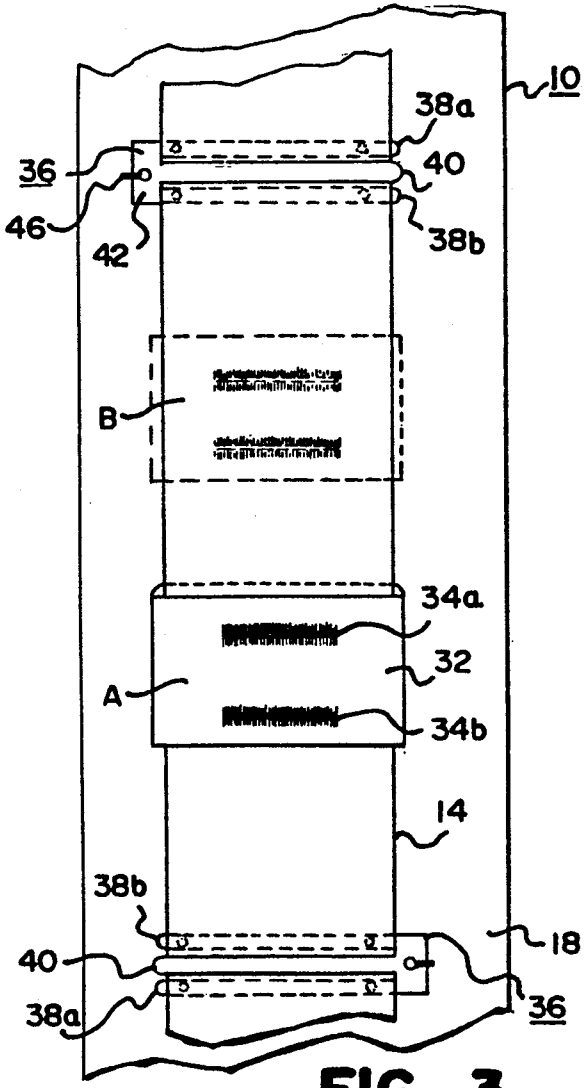
FIG. 3 is an enlarged fragmentary view of a second embodiment of the tie restraint apparatus of the present invention attached to a necktie, showing use of clip components to anchor the tail of the necktie in place.

An alternative form of tail attachment means is illustrated in FIGS. 3 and 4. In this embodiment, each attachment means comprises a clip 36 attached to the back 18 of the tie. The clip 36 shown includes two base prongs 38*a*, 38*b*, which are each attached to the tie, a third restraint prong 40 adapted to receive and retain the tie tail 14, and a foot 42.

The clips 36 should be constructed from a material with sufficient resilience that they will tightly grip the tail 14 while withstanding repeated flexing and distortion caused by the tying process. Preferably, the clips 36 are constructed from clear plastic, heat resistant plastic (e.g. similar to that commonly employed in shirt collar stays), metal, etc. A preferred clip is flat and has dimensions of approximately 1 ¾ inches by one inch. The clips may also be made with removable anchoring means (e.g. allegator clips) which can be attached to the tie after it is adorned, or easily switched between ties as may be required.

Each of the clips 36 is attached to the back 18 of the tie apron in approximately the same location as the loops 24, 26 discussed above. For ease in attachment, the clips 36 are provided with openings 44*a*, 44*b*, 44*c*, 44*d*, 44*e* to permit the base prongs 38 and the foot 42 to be attached to the tie by thread 46. Additionally, the clips may be anchored using an adhesive or other suitable means. The clips 36 are affixed slightly off-center so that the tail 14 will be retained down the center of the tie when it is engaged in the clips 36.

The clips 36 function similarly to the loops 24, 26. In this instance, the horizontal member 32 is slid onto the tail 14 and centered between the two clips 36. The tail may be inserted over the base prongs 38*a*, 38*b* and under the slightly longer middle prong 40 to trap the horizontal member 32 between the clips 36. In all other respects, the apparatus functions in the same manner to provide automatic adjustability for the restraint device.

Figure 5:
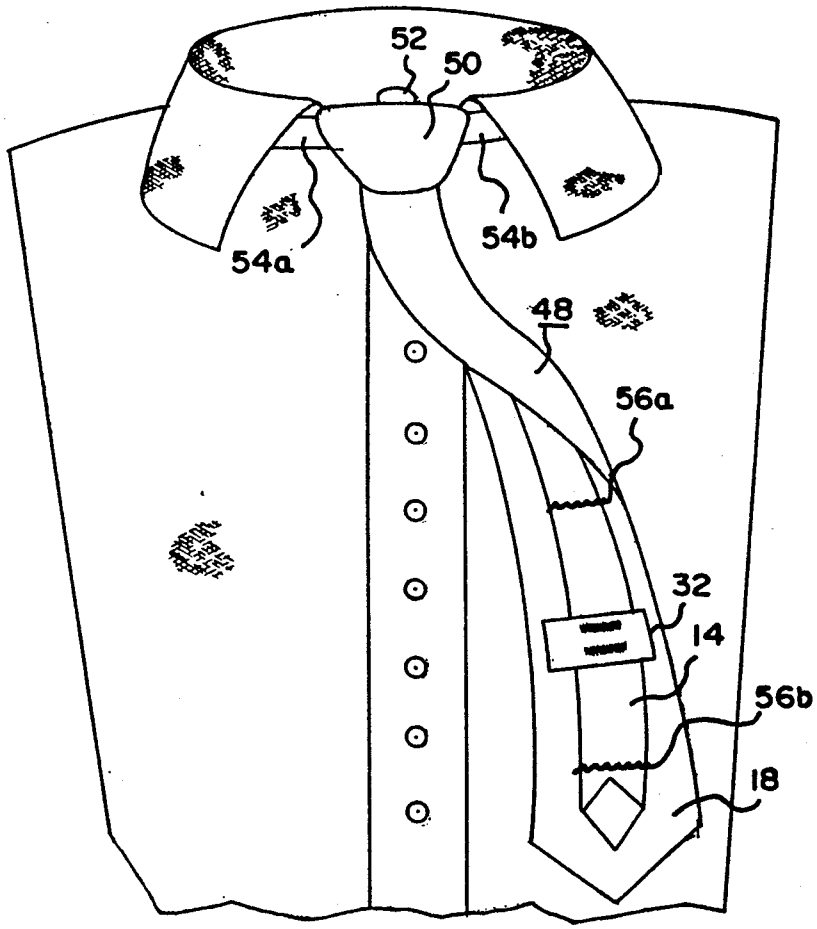
FIG. 5 is an elevational view of a third embodiment of the present invention as applied to a pre-tied necktie.

Another advantage of the present invention is its ease for use with "clip-on" and other ties with pre-tied knots. As is shown in FIG. 5, a conventional clip-on tie 48 includes a permanent, pre-tied knot 50 and means to attach the tie to a shirt collar, such as a hook 52 and stays 54*a*, 54*b*. Since the knot 50 is permanent, the tie tail 14 is non-adjustable and serves no particular purpose.

In this environment, the tail attachment means of the present invention may take any of the forms described above, or may comprise no more than orienting the horizontal member 32 intermediate the ends of the tail 14 and sewing 56*a*, 56*b* the tail 14 of the tie to the back 18 of the tie apron. It should be understood that an equally effective attachment may be achieved with fusion, bonding, glue, etc. Again, ideally the lower attachment means 56*b* is anchored 4 inches or less from the end of the tie (i.e. lower anchorage providing best tie control), with a span of about 7 inches between the lower attachment means 56*b* and the upper attachment means 56*a*. Additionally, as has been explained, it is particularly preferred to include a stiffener, such as fusion cloth, to improve operation of the tie of this embodiment.

The present invention provides a significant improvement in time and expense in creating the tie restraint apparatus. This allows the apparatus to be reliably constructed from much less tie material—reducing material costs, and yet assuring that the tie restraint apparatus is completely concealed from view.

Although particular embodiments of the present invention are disclosed herein, it is not intended to limit the invention to such a disclosure and changes and modifications may be incorporated and embodied within the scope of the following claims.

What is claimed is:

1. An apparatus for restraining a pre-tied necktie to a shirt having a collar and a buttons down its front, said necktie including an apron, with a front and back, and a tail section, which comprises:

means to anchor said tail section to the back of said apron at two positions intermediate the ends of said apron, said anchoring means including sewing the tail section to the back of the apron at said two positions;

a horizontal member adapted to be slidably mounted to the tail between said two positions, said horizontal member including an opening of sufficient dimensions to secure a button on the front of the shirt within the opening;

wherein once the necktie is adorned, the horizontal member is slid into a position along the tail section to align the opening with a button on the shirt, and the button is secured to the horizontal member so to maintain a correct placement of the apron and tail section of the tie relative to the shirt.

2. The apparatus according to claim 1 wherein the horizontal member is a piece of cloth having at least one buttonhole formed therein.

3. The apparatus according to claim 2 wherein the horizontal member and the tie are made of the same material, so that the horizontal member tends to be camouflaged when attached to the tie.

4. The apparatus of claim 2 wherein the horizontal member is adapted to be slid onto the end of the tie once the tie is adorned, and the means to removably attach the tail to the apron is attached to the tail on either side of the horizontal member to retain it in operative position.

* * * * *

UNITED STATES PATENT AND TRADEMARK OFFICE

CERTIFICATE OF CORRECTION

PATENT NO. : 5,315,713

DATED : May 31, 1994

INVENTOR(S) : Vincent J. Pileggi

It is certified that error appears in the above-identified patent and that said Letters Patent is hereby corrected as shown below:

Col. 8, line 58 - After "collar and" delete "a"

Signed and Sealed this

Twenty-third Day of August, 1994

Bruce Lehman

*Attest:*

BRUCE LEHMAN

*Attesting Officer*

*Commissioner of Patents and Trademarks*